United States Patent [19]

Thomas, III

[11] Patent Number: 5,033,337

[45] Date of Patent: Jul. 23, 1991

[54] EXTENSION ELEMENT FOR USE WITH WRENCH-TYPE HAND TOOLS

[76] Inventor: David W. Thomas, III, RD 1 Box D-400, Lock Haven, Pa. 17745

[21] Appl. No.: 615,919

[22] Filed: Nov. 20, 1990

[51] Int. Cl.[5] ..... B25G 1/04

[52] U.S. Cl. ..... 81/177.2

[58] Field of Search ..... 81/177.2, 177.1, 177.85; 403/108, 109, 324–326, 377–379, 330

[56] References Cited

U.S. PATENT DOCUMENTS 4,344,340 8/1982 Erickson .

4,367,663 1/1983 Merics ..... 81/177.2

4,581,958 4/1986 Shull ..... 81/177.2

4,620,460 11/1986 Gonzales .

4,770,073 9/1988 Palm .

*Primary Examiner*—D. S. Meislin

*Attorney, Agent, or Firm*—Terry M. Gernstein

[57] ABSTRACT

An extension unit is used in conjunction with wrench-type hand tools, such as socket and ratchet wrenches. One form of the unit includes a handle and an extension arm that has a plurality of spring-loaded balls thereon at distances that are spaced apart from each other along the longitudinal axis of the extension arm by increments that are uniform. A further extension element is attached to the handle and a bayonet coupling is used to properly align the further extension element with respect to the handle. A second form of the unit includes a spring loaded catch and spring loaded anchors.

5 Claims, 5 Drawing Sheets

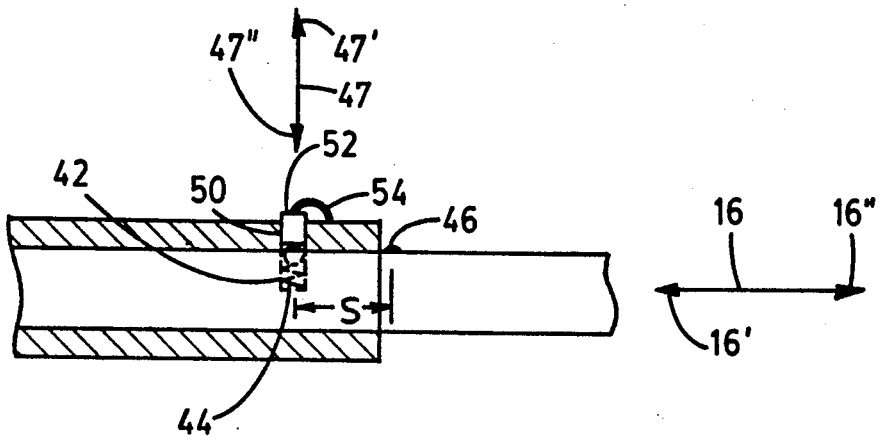
FIG. 2
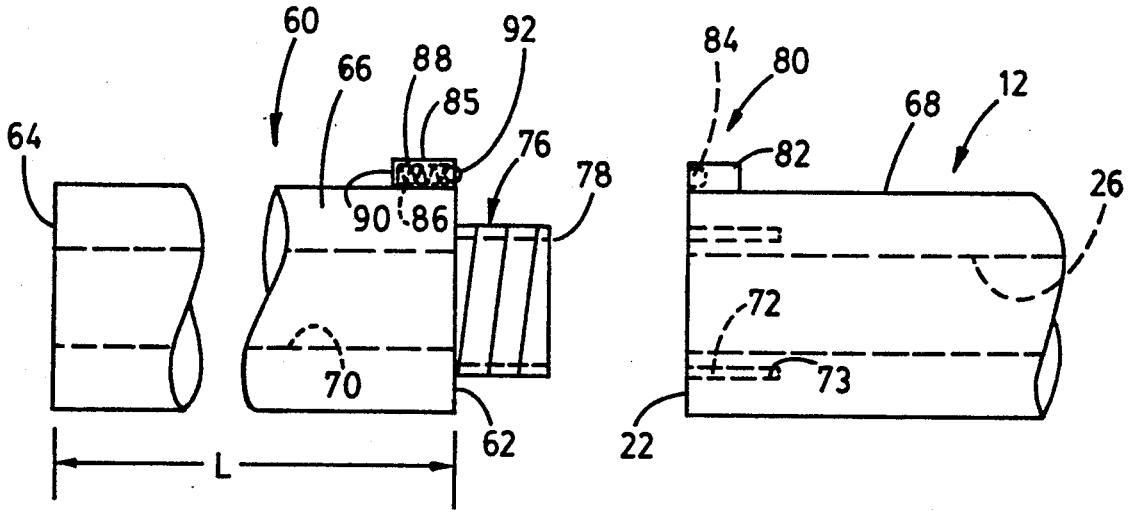
FIG. 3
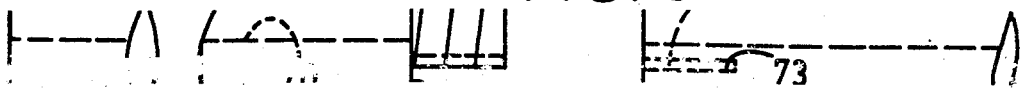

EXTENSION ELEMENT FOR USE WITH WRENCH-TYPE HAND TOOLS

TECHNICAL FIELD OF THE INVENTION

The present invention relates to the general art of hand tools, and to the particular field of attachments for hand tools.

BACKGROUND OF THE INVENTION

As is well known, a wrench is a hand tool used for holding and turning elements such as nuts, pipes, spark plugs, and the like. There are many kinds of wrenches, including monkey wrenches, single-ended wrenches, double-ended wrenches, box wrenches, and the like. Two common wrenches are the socket wrench which combines an offset handle with a male drive piece having a spring-loaded bearing lock on various sized sockets, and a ratchet wrench which is a socket wrench having a ratchet mechanism which controls the direction of applied torque.

Wrenches are used by mechanics in all sorts of applications, and in all sorts of conditions. For example, an automobile mechanic may e required to apply a ratchet wrench to various elements in an automobile engine. However, if such elements are in difficult-to-reach locations, proper application of torque can be difficult. This problem is especially apparent if the ratchet wrench is not long enough to properly reach the desired element.

Heretofore, it has not been possible for a hand tool such as a wrench to be easily extended to the precise length required for a particular job. Either the tool could not be extended far enough or it could only be extended to a length which was so great that the extended tool was either too cumbersome to use in an efficient manner or could not properly fit into the work space available.

Therefore, there is a need for an extension unit which can be used on a hand tool, especially on a socket or ratchet wrench, to efficiently extend the reach of such hand tool to a length which is exactly what is required for a particular job.

OBJECTS OF THE INVENTION

It is a main object of the present invention is to provide an extension unit which can be used on a hand tool.

It is another object of the present invention to provide an extension unit which can be used on a hand tool, especially on a socket or ratchet wrench.

It is another object of the present invention to provide an extension unit which can be used on a hand tool, especially on a socket or ratchet wrench to efficiently extend the reach of such hand tool to a length which is exactly what is required for a particular job.

SUMMARY OF THE INVENTION

These, and other, objects are achieved by an extension unit which is used with a wrench-like hand tool, especially a socket or ratchet wrench, which includes a hand grip handle having an extension arm slidably received therein. The extension arm is connected to the handle by a connection means which permits the extension arm to move in precise increments with respect to the handle element. The connection means includes a plurality of uniformly spaced apart snap balls on the extension arm and one bore in the handle into which at least one of the balls is received to couple the extension arm to the handle. A further extension means includes a housing connectable to the handle for extending the reach of the overall unit.

The unit of the present invention permits a user to extend the reach of a socket or ratchet wrench to the exact length required so a job can be performed using a hand tool that reaches the work yet is not so large or cumbersome as to inhibit completion of the work in an efficient manner.

BRIEF DESCRIPTION OF THE DRAWING FIGURES

FIG. 2 is an elevational view of a portion of the extension unit showing a coupling means for coupling an extension arm of the unit to a handle of the unit.

FIG. 3 is an elevational view of a portion of the extension unit in conjunction with a portion of a further extension means.

DETAILED DESCRIPTION OF THE PREFERRED EMBODIMENT OF THE INVENTION

Figure 1:
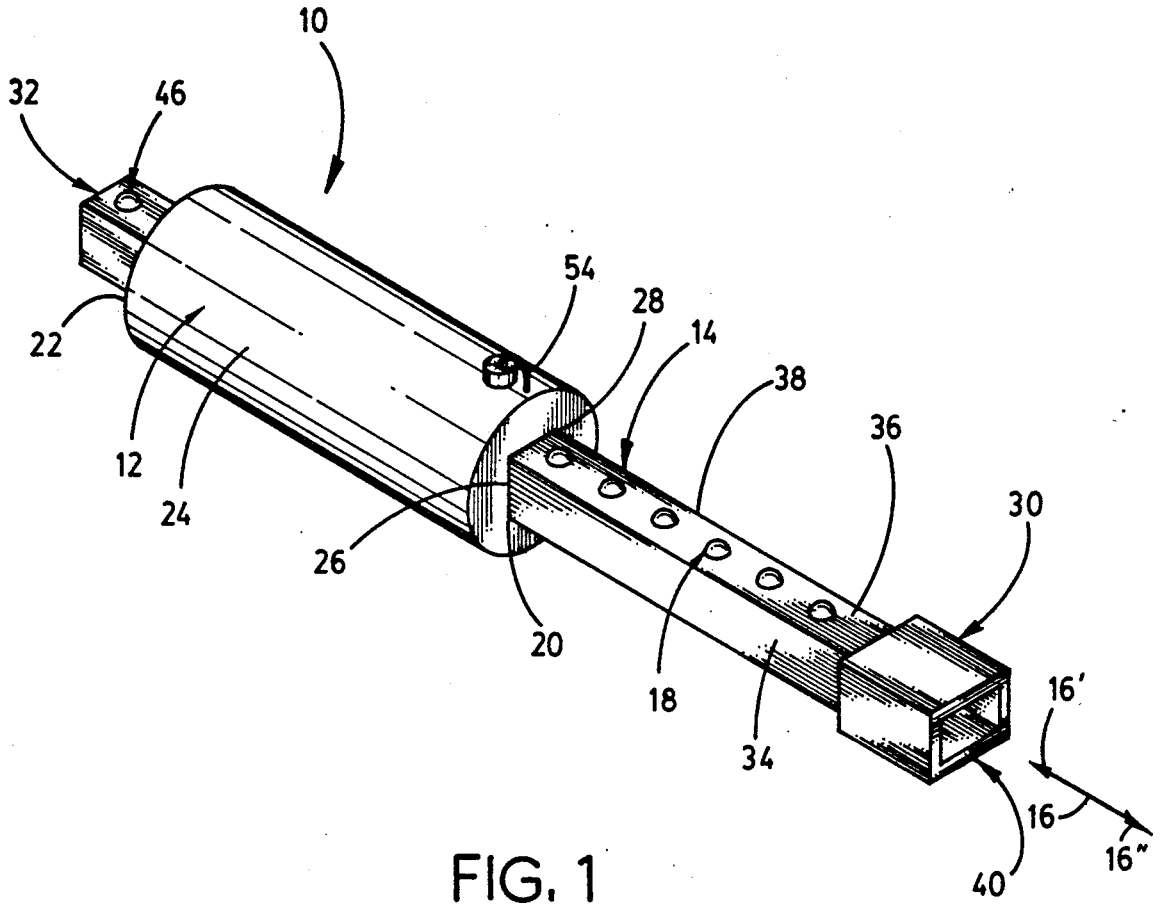
FIG. 1 is a perspective view of an extension unit embodying the present invention.

Shown in FIG. 1 is an extension unit 10 embodying the present invention. The extension unit 10 includes a handle element 12 which is grasped by a user and which receives an extension arm element 14 in a slidable manner.

The extension arm is movable in directions 16' and 16'' indicated by double-headed arrow 16 to alter the length of the extension arm with respect to the handle 12. The user grasps the handle element, and the extension arm element is coupled to the handle by a connection means 18.

Specifically, the handle element 12 is a hollow tubular element having a first end 20 and a second end 22 that are connected together by a cylindrical body 24 having a longitudinal axis extending from the end 20 to the end 22. An axial bore 26 extends from the end 20 to the end 22, and is rectangular in cross sectional shape. The rectangular shape of the bore facilitates proper application of torque using the handle element without danger of slipping between the extension arm and the handle. The rectangular bore 26 includes sides which intersect to form corners, such as corner 28.

The extension arm element 14 includes a first end 30 and a second end 32 which are connected together by a monolithic body 34. The monolithic nature of the body 34 permits application of torque without danger of breaking the body. The body 34 includes a longitudinal axis that extends from end 30 to end 32, and is rectangular in cross section, and has a size that permits the extension element to be received in the bore 26 to slide in the directions 16' and 16'' with respect to the handle element. The extension arm element body 34 has sides, such as side 36, which intersect each other to define corners, such as corner 38. The extension arm corners 38 are aligned with the handle corners 28 so that relative twisting movement between the extension arm and the handle is prevented.

A ratchet accommodating element 40 is monolithic with the extension arm and is located near the extension arm end 30, and a socket is accommodated on the end 32. The ratchet element and the socket are not shown in FIG. 1 as such elements are well known in the art.

As best shown in FIGS. 1 and 2, the connecting means 18 includes a plurality of blind-ended bores, such as bore 42 defined in the extension arm element at locations that are spaced apart from each other along the longitudinal axis of that extension arm element. The spacing between adjacent bores is uniform over essentially the entire length of the extension arm element so that the arm can be moved in precise increments with respect to the handle. The spacing between adjacent bores is indicated as spacing S in FIG. 2. A compression spring, such as spring 44, is located in each bore 42 and is seated on and connected to the extension arm portion forming the bottom of the blind-ended bore. A ball element 46 is seated on and connected to the spring 44. The spring 44 is designed to bias the ball outwardly of the bore in direction 47' as indicated by the double-headed arrow 47.

As the extension arm moves in direction 16', the curved surface of the ball contacts the handle housing adjacent to the bore 26, and the ball is forced against the bias of the spring 46 in direction 47" toward the longitudinal centerline of the extension arm element. The ball is thus forced into the bore so the extension arm can continue to move into the handle in direction 16'.

The handle element also includes a bore 50 defined radially thereof from the outer surface of the handle body toward the longitudinal centerline of that handle and intersects the longitudinal bore 26. The bore 50 is sized to accommodate a ball 46. Thus, as soon as a ball 46 becomes aligned with the bore 50, the spring bias force of spring 44 forces that ball outwardly of the bore 42 and at least partially into the bore 50. This action causes the extension arm to be locked to the handle element by the engagement of the ball with the handle adjacent to the bore 50. Further movement of the extension arm element with respect to the handle element in the directions 16 is thus prevented by such engagement.

A release mechanism includes a release pin 52 slidably located in the bore 50 and having a first end which is in abutting contact with the ball 46 and a second end that is located near the outer surface of the handle element. A tether element 54 attaches the pin 52 to the handle element. Moving the release pin 52 in direction 47" causes that pin to contact the ball 46 and force that ball in the direction 47". The length of the pin 52 is selected so that as soon as the outer end of the pin 52 is flush with the outer surface of the handle element, the other end of the pin is flush with the handle adjacent to the bore 26 and the ball 46 will have been forced into the blind-ended bore 42 far enough to permit the ball to pass by the handle element portion located adjacent to the bore 50 thereby permitting the extension arm element to move in direction 16' or 16". In this manner, the position of the extension arm relative to the handle can be selected by movement in increments equal to the spacing S.

The extension unit also includes a further extension element 60, best shown in FIG. 3. The extension element 60 is adapted to be attached to the handle element at end 22 of that handle element to extend the overall reach of the unit by an amount L as indicated in FIG. 3. The extension element is sized and shaped like the handle element and includes a first end 62 adapted to be located in abutting contact with end 22 of the handle element and a second end 64 that is spaced from the first end 62 by the axial length dimension of the element 60. The element 60 has a cylindrical outer surface 66 that is sized to be a continuation of the outer surface 68 of the handle element when the extension element 60 is in place. A bore 70 extends from end 62 to end 64 of the element 60 and is sized and shaped identically to the bore 26 to form an extension thereof when the element 60 is in place.

The element 60 is coupled to the handle element 12 by a coupling means that includes an annular groove 72 defined in the handle element from the end thereof towards the end 20 thereof. The handle includes a screw thread 73 thereon adjacent to this annular groove so the groove forms an internally threaded female element of the coupling means.

A male element of the coupling means includes an annular tubular extension 76 on the extension element 60 and extending from end 62 thereof along the longitudinal centerline thereof outwardly away from the end 62 for a distance equal to the depth of the annular groove 72. A thread 78 is defined on the outer surface of the tubular extension 76 and is sized and located to cooperatively couple with the screw thread 73 on the handle element.

Using the cooperating screw threads 73 and 78, the extension element 60 is attached to the handle element.

In order to ensure that the bore 70 is in proper orientation with the bore 26, a position setting means which includes a bayonet coupling unit 80 is mounted on the outer surfaces of the handle element and the extension element. The bayonet coupling unit is located to couple and stop further rotation of the extension element 60 with respect to the handle element as soon as bore 70 is in a desired orientation with respect to the bore 26. That is, when the corners of the bore 70 are aligned with the corners 28 of the bore 26, and the ends 22 and 62 are in abutting contact, the bayonet coupling unit will couple and prevent further rotation of the element 60 with respect to the handle 12. This will permit the extension arm element to move into bore 70 from bore 26 without interference from non-aligned corners The bayonet coupling unit 80 includes a housing member 82 on the handle 12 near the handle end 22. The member 82 includes a cavity 84 which is concave with respect to the plane containing the end 22.

The unit 80 further includes a ball housing 85 mounted on the element 60 near end 62 thereof The ball housing includes a cylindrical body having a bore 86 defined therein, with a compression spring 88 connected at one end thereof to a rear wall 90 of the cylindrical body. A ball 92 is located in the housing 85 and is connected to the spring 88 to be biased outwardly of that housing by the spring. The ball 92 is sized to be received in the cavity 84 when the ball is aligned with that cavity.

The housing 82 and the housing 85 are located on the elements 12 and 60 respectively so that as soon as the corners of bore 70 are aligned with the corners of bore 26, the ball 92 will be aligned with the cavity 84. The ball and cavity are also located relative to the planes containing the ends 62 and 22 respectively so that as soon as the end 62 is in abutting contact with the end 22, the ball 92 will be in position to snap into the cavity 84 as soon as the corners of bore 70 are aligned with the corners of bore 26 thereby preventing further rotation of the element 60 with respect to the handle 12. In this manner, the extension element 60 will be properly aligned with the handle when it is attached thereto.

A unit 100 is shown in FIGS. 4–8 and is alternative form of the unit discussed above with respect to FIGS. 1–3. The unit 100 includes a tubular outer sleeve 102 having a first end 104 and a second end 106 connected together by a cylindrical hollow wall 108. The outer sleeve 102 includes an outer surface 110 and an inner surface 112 with a central longitudinal centerline extending from end 104 to end 106.

Figure 4:
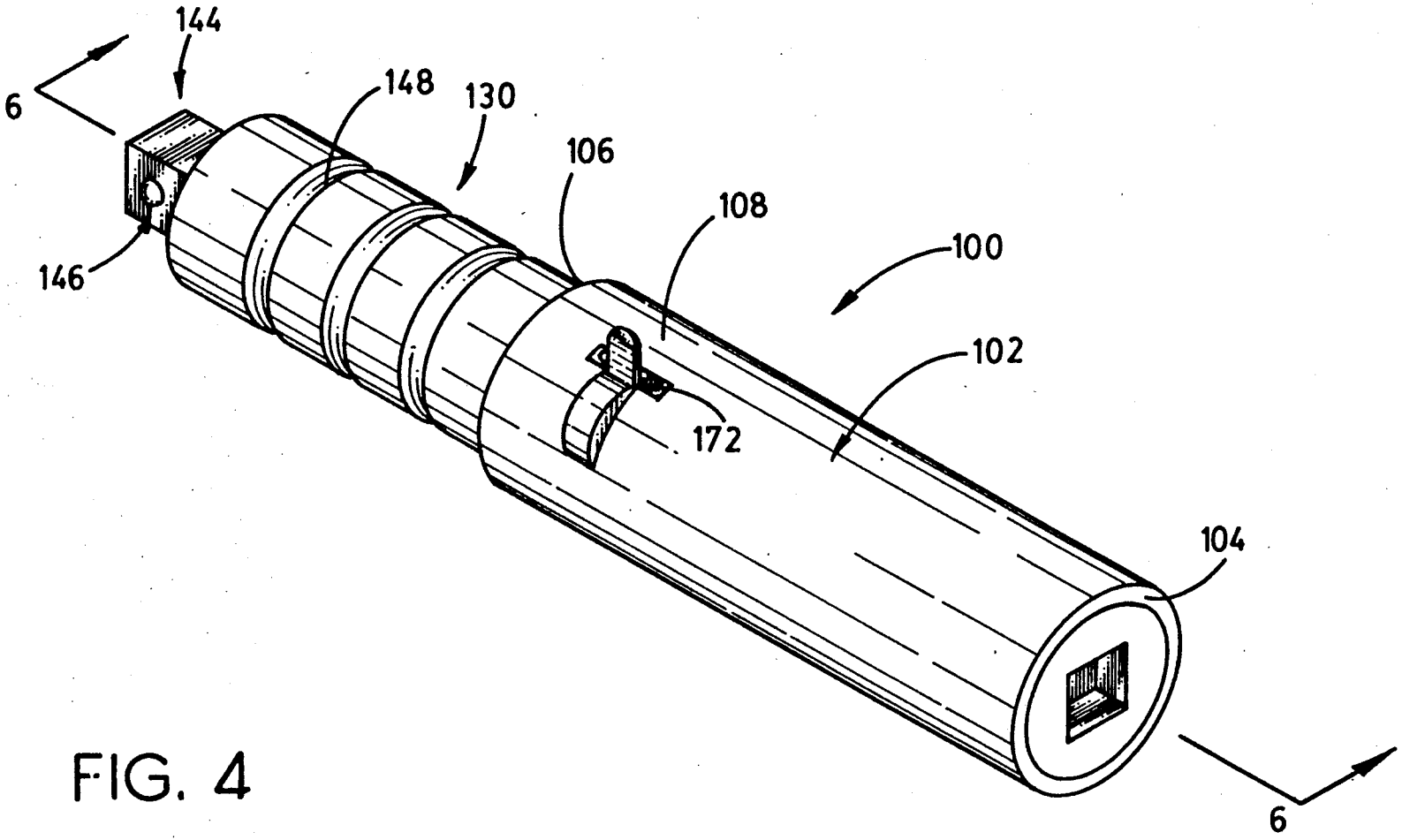
FIG. 4 is a perspective view of an alternative form of the extension unit of the present invention.
Figure 6:
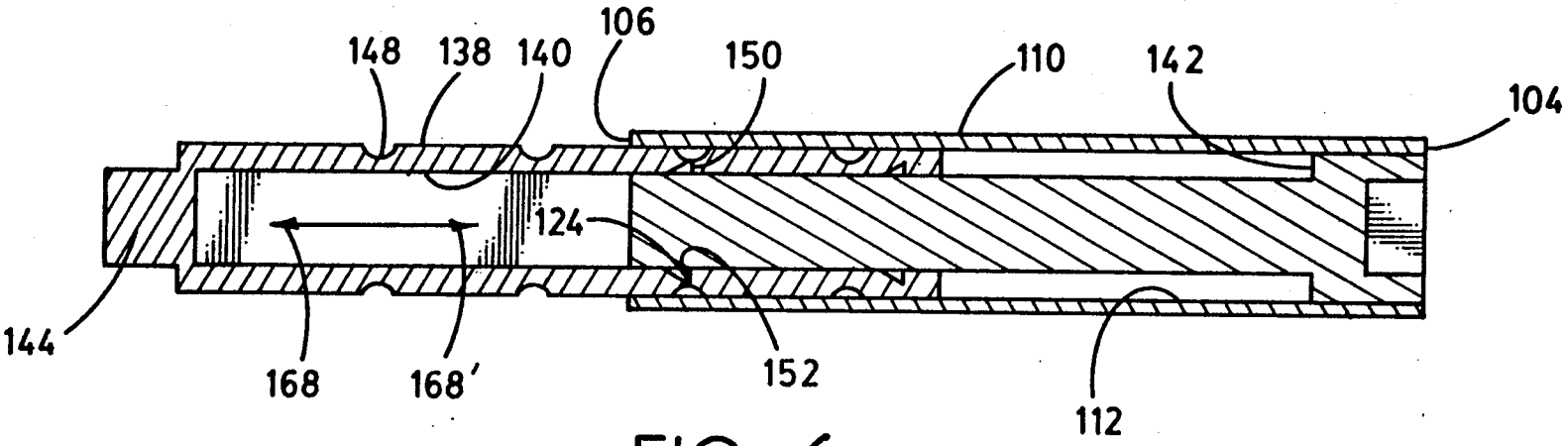
FIG. 6 is a sectional side elevational view of the alternative unit taken along line 6—6 of FIG. 4.

An insert element 114 is slidably received in the outer sleeve as shown in FIGS. 4 and 6. The insert element 114 includes a distal end 116 and a proximal end 118 with a body 120 connecting the distal end to the proximal end. The body 120 is square in transverse cross sectional shape and has a longitudinal centerline that is coincident with the longitudinal centerline of the outer sleeve when the insert element is positioned in the outer sleeve An adapter element 122 is fixed to the insert element distal end and includes a square bore 124 defined therein. An attaching mechanism 126 is located near the insert element proximal end 118 and releasably attaches the insert element to the outer sleeve. The attaching mechanism will be discussed in detail below.

Figure 5:
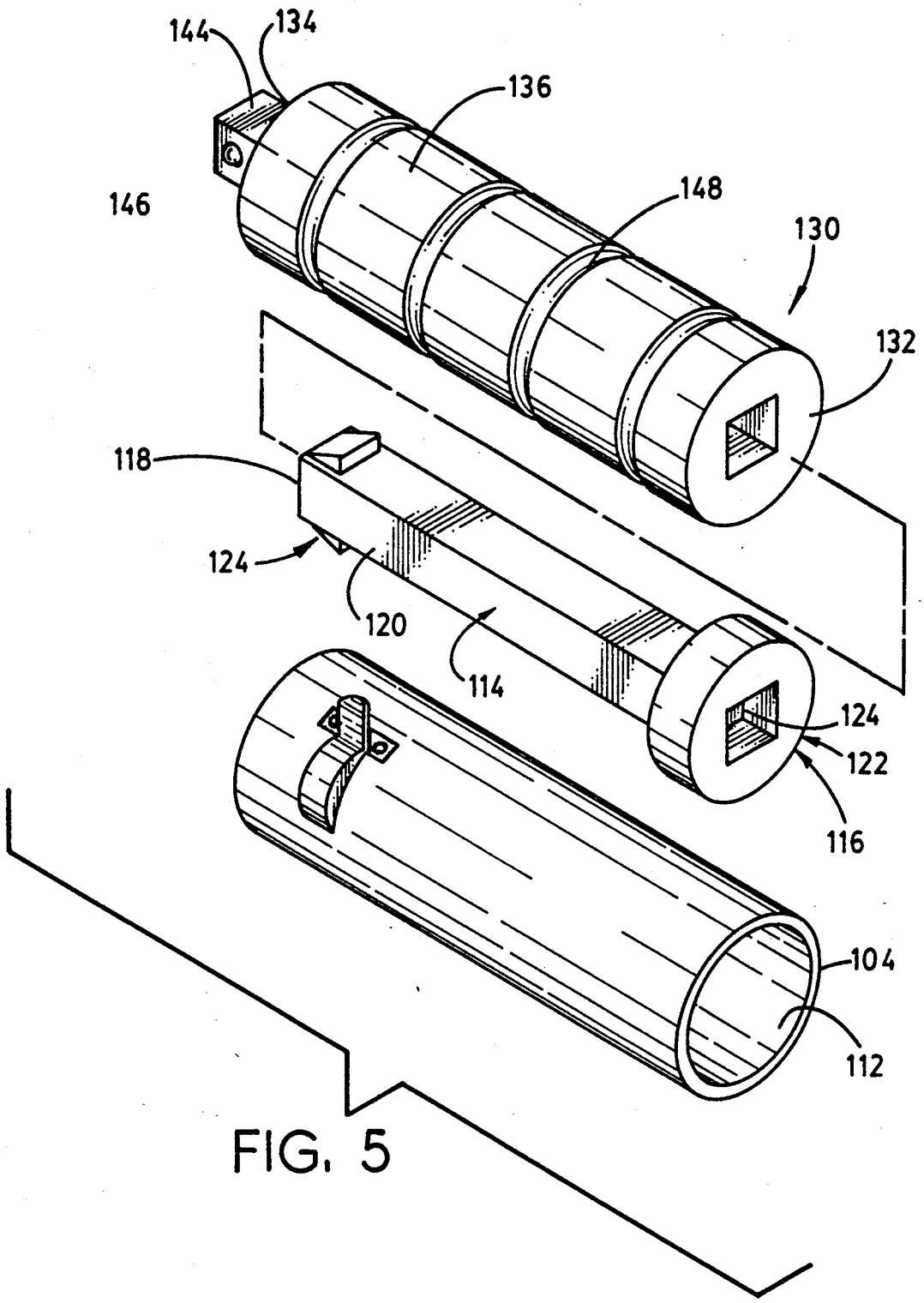
FIG. 5 is an exploded perspective view of the alternative form of the unit.

A shaft element 130 is slidably received within the outer sleeve and is interposed between that outer sleeve inner surface 102 and the insert element 114 when the unit 100 is assembled as best indicated in FIGS. 4 and 6. The shaft element includes a first end 132 and a second end 134 connected together by a cylindrical hollow wall 136 having an inner surface 138 and an outer surface 140. The shaft wall is hollow and includes a longitudinal centerline which extends between the ends 132 and 134 and is coincident with the outer sleeve longitudinal centerline when the shaft element is positioned in the outer sleeve as shown in FIGS. 4 and 6. As best shown in FIG. 5, the shaft element has a square internal cross section which is sized to slidably receive the insert element square body 120. The length of the insert element as measured between the ends 132 and 134 is less than the length of the outer sleeve as measured between the sleeve ends 104 and 106 and greater than the distance between rear surface 142 of element 122 and proximal end 118 of the insert element 114. An adapter element 144 is fixedly attached to the insert element adjacent to end 134 thereof and includes a locking button 146 for releasably attaching that adapter element to a hand tool.

The shaft 130 has a plurality of circular indentations, such as indentation 148, defined therein at locations which are spaced apart from each other along the length of the shaft. The indentations extend completely around the outer circumference of the shaft and form one portion of a mechanism which locks the shaft to the outer sleeve in a chosen orientation relative to each other. The shaft also includes two lock receiving depressions 150 and 152 defined therein adjacent to the inner surface 140 thereof. These depressions receive the locking elements 124 to attach the insert element 114 to the shaft 130. The insert element can be moved with respect to the shaft by first forcing the insert element towards the end 134 of the shaft to move the elements 124 out of the depressions 150 and 152, and then rotating that insert element about its longitudinal centerline to move these elements 124 out of alignment with the depressions. The insert element can then be withdrawn from the shaft.

Figure 7:
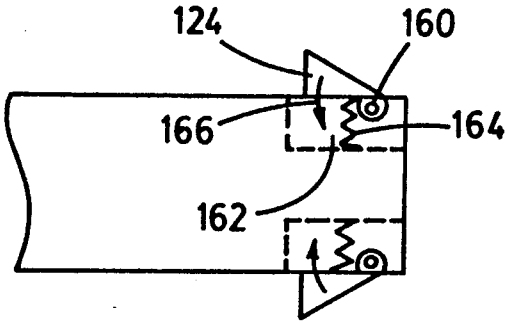
FIG. 7 illustrates an attaching mechanism for an insert element of the alternative unit.

As indicated in FIG. 7, each of the elements 124 is pivotally attached to the insert element by a pivot pin 160 adjacent to a receiving chamber 162 defined in the insert element. Each element also includes a spring element 164 having one end thereof which has one end seated against the insert element at the bottom of the receiving chamber and has another end thereof seated against the element 124. The spring biases the element outwardly of the receiving chamber; whereas, contact with the shaft forces the element 124 in direction 166 into the chamber. Due to this arrangement, the insert element can move in direction 168 in FIG. 6, but cannot move in direction 168′ as shown in FIG. 6 when the elements 124 are seated in the depressions 150 and 152.

Figure 8:
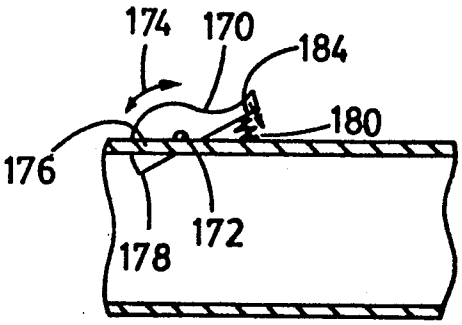
FIG. 8 illustrates a latching mechanism for attaching a shaft element of the alternative form of the unit to a sleeve element of that alternative unit.

The shaft 130 is locked to the sleeve 102 by a latching mechanism shown in FIGS. 4, 5 and 8. The latching mechanism includes a handle 170 pivotally mounted on the sleeve by a pivot mount 172 to move about that mount in the directions shown in FIG. 8 at 174. The sleeve includes a slot 176 through which engaging end 178 of the handle moves toward and away from the longitudinal centerline of the sleeve. A spring 180 has one end seated on the sleeve outer surface and another end seated against the handle to bias the handle in direction to rotate counterclockwise about the pivot 172 so as to force the engaging end 178 into the sleeve. Manually applied pressure on the handle is used to overcome the bias of spring 180 to move the handle clockwise in direction 184.

As can be understood by comparing FIGS. 4, 5, 6 and 8, when the handle is in the FIG. 8 orientation, the engaging end 178 will engage the shaft outer surface when the shaft is in position in the sleeve. This engaging end will move into one of the indentations 148 to lock the shaft to the sleeve. The lock is released by moving the handle in the releasing movement indicated by arrow 184 in FIG. 8. In this manner, the overall length of the unit 100 can be adjusted while still retaining the features discussed above with respect to the embodiment shown in FIGS. 1–3.

It is understood that while certain forms of the present invention have been illustrated and described herein, it is not to be limited to the specific forms or arrangements of parts described and shown.

I claim:

1. An extension unit for use with wrench-type hand tools comprising:

(A) a tubular hollow handle element having
  (1) a first end,
  (2) a second end,
  (3) a cylindrical body connecting said first and second ends together, said cylindrical body including a longitudinal axis extending from said first end to said second end, and
  (4) a bore defined through said body from said first end to said second end, said bore being rectangular in cross section and including planar sides, adjacent ones of which intersect each other to form corners;

(B) a monolithic extension arm element slidably attached to said handle element and including
  (1) a first end,
  (2) a second end,
  (3) a ratchet accommodating element on said extension arm first end, (4) means for accommodating a socket element on said extension arm second end, (5) said extension arm including a longitudinal axis extending from said extension arm first end to said extension arm second end and having a rectangular cross section with planar sides adjacent ones of which intersect each other to form corners, said extension arm corners being received in said handle bore corners;

(C) connecting means for coupling said extension arm element to said handle element and including (1) a plurality of blind-ended bores defined in said extension arm at locations which are uniformly spaced apart along said extension arm longitudinal axis, (2) a spring element located in each blind-ended bore and being connected at one end thereof to said extension arm element, (3) a ball element in each blind-ended bore and being connected to the spring element in said blind-ended bore, said spring element biasing said ball element outwardly of said blind-ended bore, (4) a release pin bore defined through said handle element adjacent to said handle element first end to intersect said handle element bore, (5) a release pin slidably mounted in said release pin bore with a lower end located in said release pin bore and an upper end which is located outside of said release pin bore, said release pin being slidable in said release pin bore from a first location with said release pin lower end spaced from said handle element bore to a second position with said release pin lower end being flush with said handle element adjacent to said handle element bore, and (6) a tether element connecting said release pin to said handle element.

2. The extension unit defined in claim 1 wherein said ratchet accommodating element is rectangular in shape.

3. The extension unit defined in claim 2 further including a further extension unit which includes (1) an annular bore defined in said handle element to extend along said handle element longitudinal axis from said second end, said annular bore being circular and having a radius which is larger than a dimension of one of said rectangular bore sides so that said annular bore encircles said handle element rectangular bore, (2) a screw thread on said handle element adjacent to said annular bore so that said annular bore is internally threaded, (3) a second extension element which includes (a) a first end, (b) a second end, (c) a cylindrical body connecting said second extension element first and second ends, said cylindrical body having a longitudinal axis extending from said second extension element first end to said second extension element second end, (d) a rectangular bore defined along said second extension element longitudinal axis, said second extension element rectangular bore being sized to match the size and shape of said handle element rectangular bore, (e) a tubular extension element on said second extension element first end and extending along said second extension element longitudinal axis from said second extension element first end, said tubular extension including an outer surface and having a radius which is equal to the radius of said handle element annular bore so that said tubular extension element can be received in said handle element annular bore, (f) a screw thread defined in said tubular extension element outer surface, said tubular extension element screw thread being designed to cooperate with the screw thread in said handle element annular bore to threadably couple said further extension unit to said handle element.

4. The extension unit defined in claim 3 further including a position setting means which includes (a) a cavity defining housing mounted on said handle element adjacent to said handle element second end and having a rear end which is located in a plane containing said handle element second end, (b) a cavity defined in said position setting means cavity defining housing to be concave with respect to the plane containing said handle element second end, (c) a ball housing element mounted on said further extension element near said further extension unit first end, said ball housing element including (1) a rear end spaced from said further extension unit first end, (2) a cylindrical body extending from said rear end to said further extension unit first end to be located in a plane containing said further extension unit first end, (3) a bore defined in said ball housing to extend from said rear end, (4) a spring element connected at one end thereof to said rear end and being located in said ball housing element bore, (5) a ball located in said ball housing element bore adjacent to said further extension unit first end, said ball being connected to said further extension unit spring element to be biased outwardly of said ball housing bore, (6) said ball element housing being mounted on said further extension unit and said cavity defining housing being mounted on said handle element in positions so that said further extension means ball element is received into said cavity when said further extension means first end is in abutting contact with said handle second end and said further extension means rectangular bore has the corners thereof aligned with the corner of said handle element rectangular bore.

5. An extension unit for use with wrench-type hand tools comprising:

(A) an outer sleeve having a first end, a second end, a cylindrical hollow wall connecting said first end to said second end, and a central longitudinal axis extending from said first end to said second end;

(B) a shaft received in said outer sleeve, said shaft including a first end, a second end, a hollow cylindrical wall connecting said shaft first end to said shaft second end, a longitudinal centerline which is coincident with said outer sleeve longitudinal centerline when said shaft is received in said outer sleeve, a hollow bore defined through said shaft from said shaft first end to said shaft second end, said hollow bore being rectangular in transverse cross sectional shape, and a plurality of depressions located on said shaft at positions which are spaced apart from each other along said shaft longitudinal centerline, each depression extending completely around said shaft;

(C) an insert element having a first end, a second end, and a rectangular body connecting said insert element first end to said insert element second end, said insert element being sized to slidably fit into said shaft rectangular bore;

(D) locking means for locking said insert element to said shaft and including (1) two depressions defined in said shaft adjacent to said shaft bore, said depressions being diametrically opposite to each other, (2) two triangular elements mounted on said insert element, each triangular element having a first apex spaced from the outside surface of said insert element, and a second apex, (3) a pivot pin pivotally connecting each triangular element second to said insert element, (4) a receiving chamber defined in said insert element adjacent to each triangular element and positioned with respect to said each triangular element such that sad each triangular element can move into and out of said receiving chamber, and (5) two spring elements, each located adjacent to one of said triangular elements and having one end mounted on said insert element in the receiving chamber associated with said triangular element and another end connected to said triangular element to bias said triangular element outwardly of said receiving chamber; and (E) attaching means for attaching said outer sleeve to said shaft and including (1) a pivot mount on said outer sleeve, (2) a handle pivotally mounted on said pivot mount, said handle including an engaging end and an operating end, (3) a slot defined through said outer sleeve in position to receive at least one portion of said handle, (4) said handle being positioned so that said handle engaging end moves through said attaching means slot into and out of said outer sleeve, said handle being sized so that said engaging end engages said shaft adjacent to one of said depressions to lock said shaft to said outer sleeve in a manner which prevents said shaft from moving longitudinally of said outer sleeve, and (5) a spring having one end thereof fixed to said outer sleeve and another end thereof fixed to said handle and biasing said handle into a shaft engaging position.

* * * * *